United States Patent [19]

Goode

[11] Patent Number: 4,738,115

[45] Date of Patent: Apr. 19, 1988

[54] LIQUIFIED GAS PUMPING AND VAPORIZATION SYSTEM

[75] Inventor: John E. Goode, Arlington, Tex.

[73] Assignee: Hydra Rig, Incorporated, Fort Worth, Tex.

[21] Appl. No.: 64,073

[22] Filed: Jun. 17, 1987

[51] Int. Cl.[4] ..... F17C 7/02

[52] U.S. Cl. ..... 62/53; 60/618; 60/648

[58] Field of Search ..... 62/52, 53; 60/618, 648

[56] References Cited

U.S. PATENT DOCUMENTS

| | | | |
|---|---|---|---|
| 3,100,528 | 8/1963 | Plummer et al. | 166/42 |
| 3,215,315 | 11/1965 | Graeber, Jr. et al. | 222/146 |
| 3,229,472 | 1/1966 | Beers | 62/53 |
| 4,197,712 | 4/1980 | Zwick et al. | 62/53 |
| 4,226,605 | 10/1980 | Van Don | 62/52 |
| 4,290,271 | 9/1981 | Granger | 62/53 |
| 4,409,927 | 10/1983 | Loesch et al. | 122/26 |
| 4,420,942 | 12/1983 | Davis et al. | 62/53 |
| 4,438,729 | 3/1984 | Loesch et al. | 62/53 |
| 4,599,868 | 7/1986 | Lutjeus et al. | 62/53 |

FOREIGN PATENT DOCUMENTS 1587364 4/1981 United Kingdom .

*Primary Examiner*—Ronald C. Capossela

*Attorney, Agent, or Firm*—Hubbard, Thurman, Turner & Tucker

[57] ABSTRACT

A cryogenic fluid pumping and vaporization system utilizes a heat engine to drive a cryogenic fluid pump, a coolant pump, a lube oil pump and a dynamometer, the cryogenic fluid pump and the coolant pump being driven through a hydraulic drive system, while the lube oil pump, hydraulic pump and the dynamometer are mechanically driven by the engine. Operation of the coolant pump and cryogenic fluid pump flows coolant fluid through a coolant flow circuit and flows cryogenic fluid through a cryogenic fluid flow circuit, each of these two circuits being operatively connected to a process fluid heat exchanger which transfers coolant heat to the cryogenic fluid to vaporize it. Heat from the hydraulic drive system and a lube oil flow circuit associated with the lube oil pump is transferred to the coolant flow circuit via suitable heat exchangers interposed therein. Exhaust gas heat generated by the engine is also transferred to the coolant through an exhaust gas heat exchanger. The dynamometer is connected in parallel with the coolant flow circuit to receive a selectively variable throughflow of coolant to thereby selectively vary its load on the engine and selectively vary the total heat transferred from the engine to the coolant. Heat generated within the dynamometer is transferred directly to the coolant, and the dynamometer load may be varied without altering the cryogenic fluid pumping load borne by the engine.

33 Claims, 1 Drawing Sheet

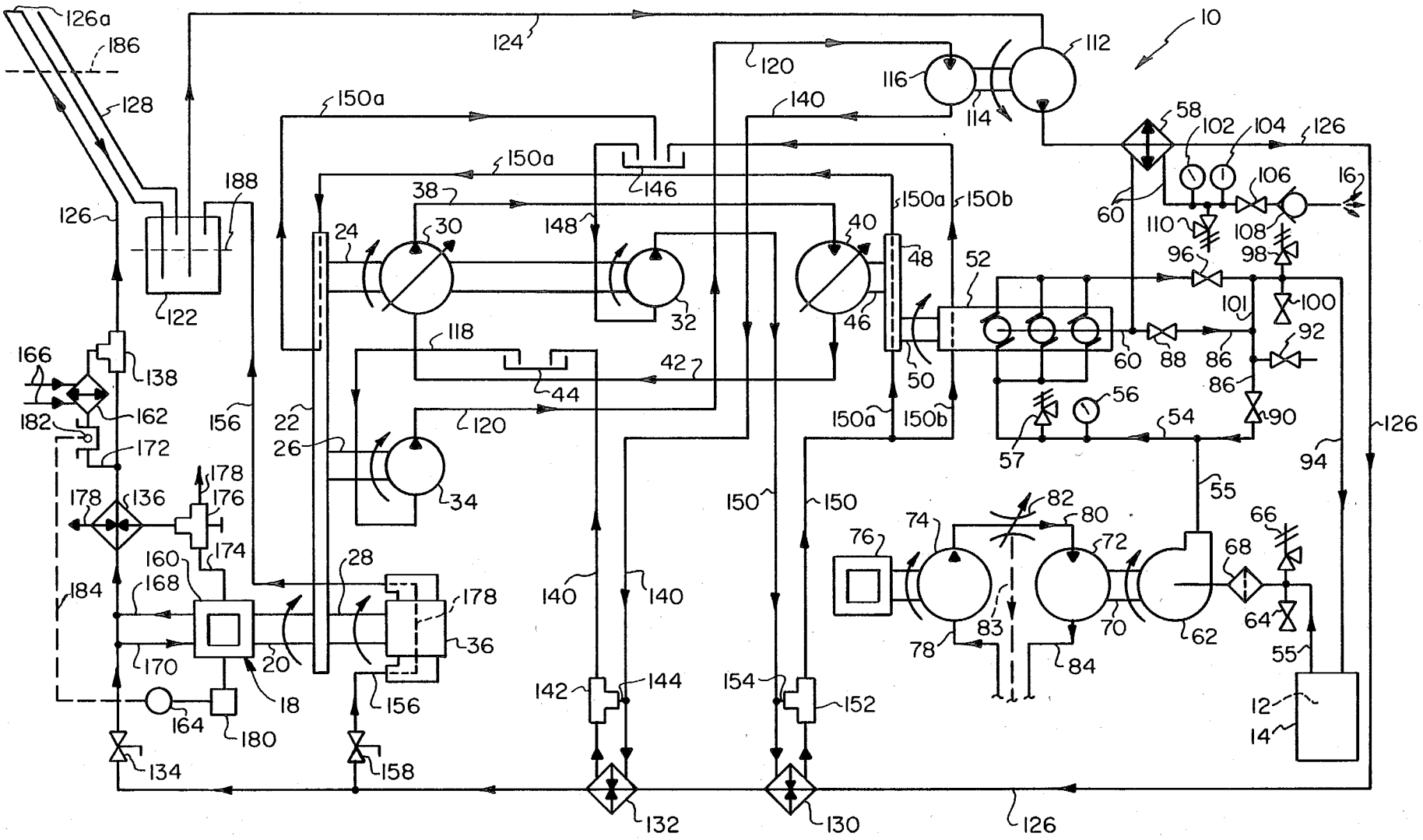

LIQUIFIED GAS PUMPING AND VAPORIZATION SYSTEM

BACKGROUND OF THE INVENTION

The present invention relates generally to fluid handling systems, and more particularly provides an improved liquified gas pumping and vaporization system which may be utilized to efficiently convert a cryogenic fluid, such as liquid nitrogen, to a gas for injection into subterranean formations for the enhancement of hydrocarbon deposit recovery therefrom, or for other uses.

In the art of liquified gas pumping systems, several proposals have been made for a system wherein a liquified gas, such as liquid nitrogen, is pumped to a predetermined discharge pressure and then vaporized for use in a variety of applications such as injection into subterranean formations for the recovery of hydrocarbon deposits. Examples of previously proposed pumping and vaporization systems of this general type are described in U.S. Pat. No. 3,229,472 to Beers and U.S. Pat. No. 4,197,712 to Zwick et al. Various other conventional nitrogen pumping and vaporization systems are exemplified in U.S. Pat. No. 4,409,927 to Loesch et al, U.S. Pat. No. 4,290,271 to Granger, and U.S. Pat. No. 4,226,605 to Van Don.

Liquified gas pumping and vaporization systems of this general type typically utilize an internal combustion engine as the main power source for driving both a process fluid pump and a coolant fluid pump. Heat generated by the driving engine is transferred to a coolant fluid flow circuit and then transferred from the coolant to the process fluid to heat and vaporize it.

One disadvantage with conventional systems is the relative complexity of the engine coolant flow circuit and the lack of reasonably precise control over the amount of heat generated for transfer to the liquid to be vaporized. Although both the Beers and Zwick et al patents suggest utilizing engine coolant as a source of heat for vaporizing a cryogenic fluid such as liquid nitrogen, Beers suggests that the drive engine be artifically loaded by a hydraulic braking device and that the heat generated in the braking device be exchanged between a hydraulic fluid and the engine coolant. This type of arrangement for artificially loading the engine for both control of liquified gas pump output and the heat generated by the braking device to heat the process fluid is relatively inefficient and results in the requirement that excess heat be rejected from the system. Stated in another manner, more heat is generated than is required by the system, and the resulting excess heat must be simply dissipated to atmosphere. Additionally, the heat generated by the artificial load device (i.e., the hydraulic braking device) cannot be directly transferred to the coolant - it must be indirectly transferred to the coolant via a separate heat exchanger. This results in a further heating inefficiency in the system.

The Zwick et al patent discloses several variations of a nitrogen pumping and vaporization system in which a back pressure device is interposed in either the hydraulic circuit, the coolant circuit, or in the process fluid circuit portion of the system in a manner such that the artificial engine load imposed by the back pressure device is made directly proportional to the flow rate of the nitrogen through the system. To maintain an automatic proportionality between the total engine heat added to the coolant and the flow rate of the nitrogen, the loading back pressure must ordinarily be set at a level corresponding to the minimum process fluid back pressure likely to be encountered during operation of the system. Stated otherwise, the artificial back pressure load must be set to completely vaporize the flowing nitrogen, and bring it to a predetermined constant discharge temperature, for the maximum nitrogen flow rate likely to be encountered. Because of this operational scheme in the Zwick et al system, a considerable amount of coolant heat must normally be rejected from the system, and cannot be used to vaporize the flowing nitrogen, during normal operating conditions of the system.

Another problem presented by conventional liquid pumping and vaporization systems arises from the connection of the driving engine's coolant jacket in series with the coolant flow circuit such that during normal periods of system operation all of the coolant fluid flows through the coolant jacket of the engine. When the temperature of the coolant exceeds a predetermined level, the engine's radiator functions in a conventional manner to protect the engine from overheating.

This connection of the engine in series with the system's coolant flow circuit effectively limits the minimum temperature of the coolant flowing therethrough to approximately 160°. Such coolant temperature limitation significantly increases the required size of various heat exchangers utilized in the system, and therefore can significantly increase the construction cost of the system.

Yet another problem encountered in conventional systems of this general type is the difficulty in precisely controlling the temperature of coolant fluid flowing through the coolant flow circuit. Because of the coolant fluid flow circuitry utilized in such conventional systems, a rather wide fluctuation in coolant temperature is frequently encountered.

It can be seen from the foregoing that a variety of problems, limitations, and disadvantages are present in conventional cryogenic fluid pumping and vaporization systems. It is accordingly an object of the present invention to provide an improved system which eliminates or minimizes above-mentioned and other problems, limitations and disadvantages associated with systems of this type.

SUMMARY OF THE INVENTION

In carrying out principles of the present invention, in accordance with a preferred embodiment thereof, an improved liquid pumping and vaporization system is provided which comprises engine means for supplying shaft power and responsively generating engine heat, a coolant flow circuit having a coolant pump therein, and a process fluid flow circuit having a process fluid pump therein. Power transfer means are also provided for utilizing shaft power supplied by the engine means to drive the coolant pump and the process fluid pump to thereby respectively flow a coolant fluid through the coolant flow circuit and to flow a process fluid, such as liquid nitrogen, from a source thereof through the process fluid flow circuit. First heat exchange means are utilized to transfer heat generated by the engine means to the coolant fluid, and second heat exchange means are utilized to transfer heat from the coolant fluid to the process fluid to heat and vaporize it.

Load means are provided which are operable to utilize coolant fluid flowing through the coolant flow circuit to impose upon the engine means a selectively variable additional shaft power load which is independent of the process fluid pumping shaft power load thereon, and to produce heat which is transferred directly from the load means to the coolant fluid.

In a preferred embodiment of the present invention, the load means comprise a dynamometer which has an internal fluid flow passage connected in parallel with the coolant flow circuit, the dynamometer being driven by shaft power from the engine means. Control valve means are utilized to divert a selectively variable quantity of coolant from the coolant flow circuit through the internal flow passage of the dynamometer to thereby selectively vary the dynamometer load on the engine, and back pressure valve means are interposed in the coolant flow circuit downstream from the control valve means to assure an adequate fluid inlet pressure at the dynamometer.

The use of the dynamometer as the artificial load device in the system of the present invention provides two distinct advantages over the various artificial load devices utilized in conventional systems. First, the heat generated by the dynamometer (via the mechanical energy transferred to the coolant flowing through its internal flow passage) is transferred directly to the coolant fluid. No multi-step heat exchange process, for example the use of an intermediate heat exchanger, is required to transfer the load device heat to the coolant fluid, and such heat is not simply dissipated to atmosphere. Secondly, and very importantly, the use of the dynamometer, connected as described to the coolant flow circuit, permits a very precise adjustment of the total engine heat transferred to the coolant fluid for use in vaporizing the process fluid and raising its discharge temperature to a predetermined level. This adjustment of the total output heat of the engine means is carried out wholly independently of the flow rate of the process fluid being vaporized. Accordingly, the total engine means heat output need not, as in conventional systems, be held at an artificially high level to cover a variety of system operating points. Thus, the pumping and vaporization system of the present invention may be precisely "tuned" from a heat balance standpoint such that, except for unavoidable heat transfer inefficiencies, no engine heat need be dissipated to atmosphere and thus wasted.

According to another aspect of the present invention, the engine means, which preferably comprise an ordinary diesel engine driven at a constant speed, have an integral cooling system which is connected in parallel with the coolant flow circuit instead of being connected in a conventional manner to the engine radiator. Because of this unique parallel connection of the engine cooling system to the coolant flow circuit, the maximum coolant temperature in such flow circuit may be maintained at a level substantially below the minimum coolant operating temperature within the engine's coolant jacket—i.e., well below the conventional 160° F. to 180° F. level. In fact, in the improved system of the present invention, the only real lower level limitation on the coolant temperature is its freezing point. It is thus possible, if desired, to maintain the minimum temperature of the coolant in the coolant flow circuit as low as approximately 20° F.

In addition to a cryogenic heat exchanger which effects the heat exchange between the coolant fluid and the process fluid, the system utilizes three other heat exchangers which are operatively interposed within the coolant flow circuit. The first of these three additional heat exchangers functions to transfer heat generated by mechanical inefficiencies in a lube oil flow circuit used to lubricate the power transfer means to the coolant fluid. The second heat exchanger functions in a similar manner to transfer mechanical inefficiency heat from a hydraulic fluid flow circuit portion of the power transfer means. The flow of lubricating oil and hydraulic drive fluid through these first and second additional heat exchangers is regulated by thermostatic control valves operatively positioned in such circuits. The third additional heat exchanger functions to transfer to the coolant exhaust gas heat generated by the engine.

Because of the system's unique ability to use very low temperature coolant, the fluid temperature differential across the opposite sides of these three heat exchangers is significantly increased compared to heat exchangers used for similar purposes in conventional systems. Accordingly, these heat exchangers in the present system may be considerably smaller, thus significantly reducing the overall cost of the improved system. Moreover, because of the unique temperature control aspects of the system, the heat exchangers may be oversized without causing damage to the engine or to other system components.

As previously mentioned, the engine's radiator is not connected directly to the integral cooling system of the engine. Instead, it is also connected in parallel with the coolant flow circuit and is operatively associated with the cooling fan of the engine which functions to blow ambient air across the radiator when necessary to provide additional fluid cooling for the engine. However, the precise heat balance control provided by the dynamometer, together with the low temperature coolant used in the improved system, renders the use of the engine radiator unnecessary during normal steady state operation of the improved system since there is simply no excess heat being generated which must be dissipated through such radiator. The only times during which the radiator is called upon to dissipate excess heat is when, for example, the engine is run at idle speed for extended periods of time without the flow of process fluid through the system, or when the system is operated for extended periods of time with extremely low process fluid flow and high process fluid pressures.

Because the radiator is only very seldom needed, clutch means may be provided to render the engine cooling fan inoperative during normal system operation when coolant flow through the radiator is not required. The clutch means may be controlled by appropriate sensing means which are positioned to sense (by temperature) coolant flow through the radiator. When a no-flow condition is sensed, the sensing means operate the clutch means to deactivate the cooling fan. Similarly, when coolant flow through the radiator is sensed, the clutch means are automatically operated to couple the cooling fan to the engine drive means therefor.

Coolant flow through the radiator is regulated by a thermostatic control valve operatively interposed in the coolant flow circuit and operative to divert coolant from such circuit through the radiator. This thermostatic control valve has a temperature sensing portion which is positioned in the coolant flow circuit downstream from the radiator. Because of this downstream positioning of the temperature sensing portion of the valve, the temperature of coolant in the coolant flow circuit may be precisely controlled, unlike the coolant temperature control in conventional liquid pumping and vaporization systems which attempt to control the coolant temperature by sensing its temperature upstream from the engine radiator. When the temperature setting of this thermostatic control valve is exceeded, it automatically diverts a portion of the coolant fluid through the radiator (which automatically activates the engine cooling fan) until the sensed coolant temperature is returned to its predetermined setting level. In this manner, the thermostatic control valve not only functions to assist in protecting the engine, but also functions to assure that the overall coolant temperature is maintained below a predetermined level.

To facilitate the operation of the dynamometer, the coolant flow circuit is operated in a unique "two-level" mode. The circuit is provided with a vented coolant reservoir which is positioned at a lower level than that of the dynamometer, and a downstream end portion of the circuit is positioned to define a high point of the overall coolant flow circuit. When the pumping and vaporization system is inoperative, coolant within the dynamometer drains by gravity into the vented coolant reservoir so that the coolant in the coolant flow circuit is at a first level somewhat below the high point of the circuit.

However, during normal operation of the system, the level of the coolant is automatically lowered, by operation of the coolant pump to a second, lower level within the coolant reservoir so that the dynamometer fluid is discharged to atmosphere within the coolant reservoir by gravity through a coolant fluid diverting conduit that connects the dynamometer in parallel with the coolant flow circuit. In this manner, the fluid discharge resistance on the dynamometer (which functions as an extremely inefficient centrifugal pump) is kept to a miminum so that it may be easily and smoothly operated to provide the previously described precise heat balance within the improved system of the present invention.

BRIEF DESCRIPTION OF THE DRAWING

The drawing is a schematic diagram of a liquid nitrogen pumping and vaporization system which embodies principles of the present invention.

DETAILED DESCRIPTION

Schematically illustrated in the drawing is a liquid nitrogen pumping and vaporization system 10 which embodies principles of the present invention and is utilized to pump, heat and vaporize a cryogenic process fluid such as liquid nitrogen ($LN_2$) 12 disposed within a suitable storage tank 14, and to discharge the vaporized nitrogen ($GN_2$) 16 at a predetermined temperature for use in a variety of processes such as, for example, injection into subterranean formations for the enhancement of hydrocarbon deposit recovery therefrom The prime mover for the entire system 10 is a diesel engine 18 which, in a conventional manner, is operated at a constant speed. Engine 18, which may alternatively be a spark-ignited internal combustion engine, or other suitable type of heat engine has an output shaft 20 that is drivingly coupled to a gear box 22 having output drive shafts 24, 26 and 28. Output shaft 24 drives a variable displacement main hydraulic pump 30 and a fixed displacement lube oil pump 32, output shaft 26 drives a fixed displacement hydraulic pump 34, and output shaft 28 drives a dynamometer 36.

During operation thereof, the main hydraulic pump 30 forces hydraulic fluid, via a supply conduit 38, into and through a variable displacement hydraulic motor 40, the hydraulic fluid discharged from a motor 40 being returned to the inlet of the hydraulic pump 30 through a return conduit 42. The pump 30 and the motor 40 which it hydraulically drives are suitably charged by conventional charge pump circuitry (not illustrated) which draws hydraulic fluid from a hydraulic reservoir 44. The hydraulic motor 40 has an output shaft 46 which is drivingly coupled to a gear box 48 that has an output shaft 50 which is in turn drivingly coupled to a main high pressure triplex nitrogen pump 52.

The inlet of nitrogen pump 52 is operatively connected by an inlet conduit 54 to an outlet conduit 55 of the nitrogen tank 14. A suction pressure gauge 56 and a safety relief valve 57 are operatively connected in conduit 54. Liquid nitrogen discharged from the pump 52 is forced through one side of a cryogenic heat exchanger 58 by means of a discharge conduit 60 operatively connected to the outlet side of the pump 52. In a manner subsequently described, engine heat is transferred from the other side of the heat exchanger 58 to vaporize the liquid nitrogen flowing through the heat exchanger to form the gaseous nitrogen 16 discharged from the conduit 60 at a predetermined temperature.

To elevate the pressure of the liquid nitrogen received at the inlet of the high pressure nitrogen pump 52, a conventional boost pump circuit is utilized, such circuit including a process fluid boost pump 62 operatively interposed in the outlet conduit 55 downstream from a hose drain valve 64, a safety relief valve 66, and a strainer 68 also connected in the outlet conduit 55. The boost pump 62 is driven by the output shaft 70 of a fixed displacement hydraulic motor 72 which is driven by a fixed displacement hydraulic pump 74 that is drivably connected to the cam tower 76 of the diesel engine 18. During operation of the pump 74, hydraulic fluid is drawn from the hydraulic reservoir 44 into the inlet of pump 74, through an inlet conduit 78, and then discharged into and through the hydraulic motor 72 via a supply conduit 80 having a variable flow control device 82 connected therein and having a bypass conduit 83 which permits a selectively variable flow of hydraulic fluid to be returned to reservoir 44. Hydraulic fluid discharged from the motor 72 is flowed back into the hydraulic reservoir 44 through an inlet conduit 84.

The cryogenic flow circuit just described is also provided with a variety of other generally conventional flow control components and subcircuitry which include a nitrogen pump priming loop formed by a priming conduit 86 interconnected between conduits 54 and 60 as illustrated, and provided with a high pressure tank return valve 88, a centrifugal pump cooldown valve 90, rapid pump cool down valve 92 vented to atmosphere. The nitrogen pump 52 is further provided with a liquid nitrogen recirculation subcircuit defined by a liquid nitrogen recirculation line 94 interconnected between the outlet of the pump 52 and the nitrogen tank 14 and having connected therein a recirculation valve 96, a safety relief valve 98, and a hose drain valve 100. Recirculation line 94 is connected to primary conduit 86 by means of an interconnecting conduit 101. Finally, the nitrogen discharge conduit 60, downstream from the heat exchanger 58, has operatively connected therein a discharge pressure gauge 102, a discharge temperature gauge 104, a discharge valve 106, a check valve 108, and a safety relief valve 110.

In addition to its nitrogen flow circuit the liquid pumping and vaporization system 10 is also provided with a coolant liquid flow circuit which includes a centrifugal coolant pump 112 that is drivably connected to the output shaft 114 of a fixed displacement hydraulic motor 116 which is in turn driven by the hydraulic pump 34. Operation of the pump 34 draws hydraulic fluid from the reservoir 44 into the inlet of pump 34, via an inlet conduit 118, and then forces the hydraulic fluid through the motor 116, via an outlet conduit 120, to thereby drive the coolant pump 112. Driven in this manner, the coolant pump 112 draws coolant from a coolant reservoir 122, positioned beneath the level of the dynamometer 36, through a coolant inlet conduit 124 and forces the received coolant through a main coolant supply conduit 126 back into the coolant reservoir 122 which is vented to atmosphere by means of an open vent line 128. A downstream end portion 126$_a$ of the coolant supply conduit is carried upwardly to define the highest point in the overall coolant circuit and then is carried downwardly into the vented coolant reservoir 122. In a similar manner, the vent line 128 is carried upwardly to this high point of the coolant flow circuit.

Coolant discharged from the coolant pump 112 through the supply conduit 126 is sequentially flowed through the cryogenic heat exchanger 58, a lube oil-to-coolant heat exchanger 130, a hydraulic oil-to-coolant heat exchanger 132, a back pressure valve 134, an engine exhaust gas-to-coolant heat exchanger 136, and a thermostatic control valve 138. Hydraulic fluid flowing through and operating the hydraulic motor 116 is discharged therefrom through an outlet conduit 140 which discharges into the hydraulic reservoir 44. Hydraulic fluid discharged through the conduit 140 is sequentially flowed through the heat exchanger 132 and a thermostatic control valve 142 interconnected between portions of the conduit 140 upstream and downstream of the heat exchanger 132 by a branch conduit 144. Positioning of control valve 142 in this manner affords precise control of the fluid temperature in the hydraulic drive circuit, to thereby protect the components therein, regardless of variations in the fluid temperature in the coolant flow circuit.

As previously mentioned, the gear box output shaft 24, which drives the main hydraulic pump 30, also is utilized to drive the lube oil pump 32. Driven in this manner, the lube oil pump 32 draws lubricating oil from a suitable reservoir 146 into its inlet via an inlet conduit 148. Lubricating oil discharged from the pump 32 is sequentially flowed, via an outlet conduit 150, through the heat exchanger 130, a thermostatic control valve 152, and, via branch lines 150$_a$ and 150$_b$, through the warm end of the nitrogen pump 52, the gear box 48 and the gear box 22, to lubricate the nitrogen pump and the gear boxes, before being returned to the lube oil reservoir 146. The thermostatic control valve 152 is interconnected between portions of the outlet conduit 150 positioned upstream and downstream of the heat exchanger 130 by means of a branch conduit 154. Positioning of control valve 152 in this manner affords precise control of the fluid temperature in the lube oil circuit, to thereby protect the components therein, regardless of variations in the fluid temperature in the coolant flow circuit.

In order to impose a selectively variable artificial load on the engine 18, for purposes subsequently described, the dynamometer 36 is interposed in a branch coolant supply conduit 156 connected at its inlet end to the main coolant supply conduit 126 between the heat exchanger 132 and the back pressure valve 134, and emptying at its open outlet end into the coolant reservoir 122. The dynamometer load imposed on the engine shaft 20 may be selectively varied by adjusting a dynamometer control valve 158 connected in conduit 156 between the dynamometer and the main coolant supply conduit 126 to thereby vary the coolant flow through the dynamometer. The back pressure valve 134, during flow of coolant through the main supply conduit 126, functions to establish a relatively small back pressure (on the order of about 40 psig.) in the coolant conduit 126 to assure an adequate inlet supply pressure to the dynamometer which functions as an extremely inefficient centrifugal fluid pump.

The diesel engine 18, as is customary, is provided with a coolant jacket 160, a radiator 162 through which coolant may be flowed, a radiator fan 164 adapted to blow ambient air 166 across the radiator 162, a coolant circulating pump (not illustrated) adapted to circulate coolant fluid through the jacket 160, and an integral thermostatic control valve (not illustrated) which functions to automatically divert a portion of the coolant flow through the coolant jacket 160 to and from an auxiliary cooling source via engine coolant lines 168 and 170.

In conventional liquid pumping and vaporization systems, such auxiliary cooling source is the engine radiator itself. However, for purposes subsequently described, in the present invention the cooling lines 168 and 170 are not directly connected to the engine radiator 162, but are instead connected in parallel to the main coolant supply conduit 126 between the back pressure valve 134 and the exhaust gas heat exchanger 136. Radiator 162 is separately connected in parallel with the main coolant supply conduit 126, downstream from the exhaust gas heat exchanger 136, by means of a transfer conduit 172 having an inlet portion interconnected between the conduit 126 and the radiator inlet, and an outlet portion interconnected between the radiator outlet and the thermostatic control valve 138.

Engine 18 is also provided with a hot exhaust gas discharge conduit 174 which is operatively connected to the heat exchanger 136. Interposed in the exhaust gas conduit 174 is a manually operable diverting valve 176 which may be selectively operated to either flow the engine exhaust gas 178 through the heat exchanger 136 or to bypass it.

As will now be described, a unique cooperation between and among the various previously described components and circuits of the system 10 provides it with a variety of structural and operational advantages over conventional liquid pumping and vaporization systems. In the following operational description of system 10 a number of specific flow rates and temperatures will be set forth for illustrative purposes. However, it will readily be appreciated that for systems of other sizes and vaporization applications, as well as in the system 10 itself, these flow rates and temperatures may be considerably different from those illustratively described.

OPERATION OF THE SYSTEM 10

During steady state operation of the system 10, after the previously described priming circuit has been utilized to bring the nitrogen pump 52 to its operating temperature, and the main hydraulic pump 30 and the dynamometer 36 have been adjusted as subsequently described, a predetermined flow rate of liquid nitrogen is being pumped through the cryogenic heat exchanger 58, vaporized, and discharged as gaseous nitrogen 16 as a predetermined temperature. The coolant pump 112 is drawing approximately 500 gpm of coolant fluid at approximately 100° F. from the coolant reservoir 122 and forcing the coolant through the heat exchanger 58, the coolant fluid traversing such heat exchanger transferring heat to the liquid nitrogen to heat and vaporize it.

Coolant fluid exiting heat exchanger 58 is at its lowest temperature in the coolant flow circuit (approximately 70° F.) after having raised the temperature of the gaseous nitrogen 16 to approximately 70° F. The coolant fluid then continues its forced flow through conduit 126, and through the heat exchangers 130, 132 where it receives heat from the lube oil flow circuit via conduit 150, and from the hydraulic fluid drive conduit via conduit 140, thereby reclaiming heat generated by mechanical inefficiencies in these two flow circuits.

The temperature of fluid flowing through the lube oil and hydraulic fluid drive circuits is respectively regulated by the thermostatic control valves 152 and 142 which, in a conventional manner, function to cause varying portions of fluid flowing in their associated flow circuit to either bypass or flow through its heat exchanger as required by the temperature setting of the control valve. Importantly, the temperatures of the lubricating oil and the hydraulic oil may be precisely controlled at the optimum operating temperatures of the pumping components to maximize their operational lives.

The temperature of coolant downstream from the heat exchangers 130 and 132 is increased from 70° F. to approximately 72° F. by virtue of the heat received from the hydraulic and lube oil circuits. Valve 134 exerts a relatively small (approximately 40 psig) back pressure on the coolant in supply conduit 126 downstream from heat exchanger 132 to provide sufficient dynamometer inlet pressure in the branch conduit 156. A selectively variable portion (up to about 120 gpm) of the 500 gpm of coolant flowing in condit 126 between heat exchanger 132 and the back pressure valve 134 is diverted through the internal flow passage 178 of dynamometer 36 by suitable adjustment of the control valve 158, the diverted coolant being flowed into the coolant reservoir through the downstream portion of conduit 156.

The balance of the coolant flow not diverted through the dynamometer is flowed through the exhaust gas heat exchanger 136, through the thermostatic control valve 138 and into the coolant reservoir 122. Engine heat transferred to the coolant via engine cooling line 168 raises the coolant temperature to approximately 83° F., while engine exhaust heat transferred to the coolant via heat exchanger 136 further raises its temperature to approximately 93° F. for return to the reservoir 122.

In addition to the various pumping loads borne by engine 18, and causing it to reject heat into the coolant flow circuit, the diverted coolant flow through dynamometer 36 functions to create a selectively variable artificial shaft load on the engine to transfer further engine heat to the coolant flow circuit. The amount of such additional heat is proportional to the flow rate of coolant through the dynamometer internal flow passage 178 connected in parallel with the coolant fluid flow circuit.

The use of the dynamometer 36 as an artificial load means in the system 10 provides the system with an important efficiency advantage over conventional liquid pumping and vaporization systems which use other types of load-creating means such as frictional devices or devices which create a load within the hydraulic portion of the system. The advantage is that the heat generated by the dynamometer (i.e., the artificial load means) is transferred directly to the coolant flowing through the internal flow passage 178—it is not simply dissipated to atmosphere, and there is not need to utilize a separate heat exchanger to transfer the load means heat to the coolant circuit. The use of the dynamometer 36 thus very efficiently transfers a selectively variable quantity of heat to the coolant fluid flow circuit in two manners—through increased engine heat output and by directly heating the coolant being diverted into reservoir 122 through conduit 156. The coolant fluid in conduit 156 is sufficiently heated by the dynamometer to raise the temperature of the coolant in reservoir 122 to approximately 100° F. for flow into the coolant pump 112 as previously described.

Another important operating advantage provided by the system 10 is its unique ability to utilize coolant fluid at a very low temperature compared to the minimum usable coolant fluid temperature in conventional cryogenic fluid pumping and vaporization systems. Such conventional systems are typically limited, as to coolant fluid temperature, to a minimum of approximately 160° F. This is due to the fact that in such conventional systems the driving engine is connected in series with the coolant fluid flow circuit so that essentially all of the coolant flow is at all times directed through the cooling jacket of the engine. Such driving engines, like the diesel engine 18 is in the system 10 described herein, have a normal operating temperature within the coolant jacket of approximately 180° F. Accordingly, when the engine is connected in series with the coolant fluid flow circuit, the minimum temperature of coolant continuously flowed through the engine coolant jacket must be no lower than approximately 160° F.

This series connection of the driving engine in conventional systems thus dictates the minimum coolant temperature flowing through the overall coolant flow circuit to be kept at at least 160° F. As previously described, however, in the system 10 the cooling system of the engine 18, via the cooling lines 168 and 170, is connected in parallel with the coolant fluid supply conduit 126. The engine's integral coolant pump and thermostatic valve function to circulate coolant within the coolant jacket 160 at a suitable temperature to maintain the coolant fluid temperature within jacket 160 at approximately 180° F. In the event that this coolant jacket temperature begins to rise above its normal operational setting, the engine's integral thermostatic control valve is automatically modulated to cause an inflow to the cooling jacket of coolant at approximately 72° F. from the supply conduit 126 via the cooling line 170. Heated coolant is then automatically returned to the supply conduit 126 through the engine cooling line 168. In this manner, engine coolant jacket heat is rejected directly to the coolant flowing through supply conduit 126 as previously described.

It is important to note that the engine cooling lines 168, 170 are uniquely connected not to the engine radiator 162, as is conventional, but instead are connected in parallel to the supply conduit 126 as previously mentioned. The radiator 162, as previously described, is connected in parallel to the supply conduit 126 downstream from the exhaust gas heat exchanger 136. Because of the unique parallel cooling connection of the engine 18, and due to other system features subsequently described, the radiator 162 does not function during normal steady state operation of the system 10. Unlike the engine radiators in conventional liquid pumping and vaporization systems, the radiator 162 is needed only during extended engine idle periods or during periods of system operation in which the nitrogen flow is maintained at a very low level and at high pressures for extended periods of time.

Because of the radiator 162, under most operating conditions of the system 10, is not needed to reject engine heat from the system, the radiator fan 164 is also seldom needed. Accordingly, if desired, a suitable clutch device 180 may be operatively associated with the radiator fan 164 and controlled by a suitable temperature sensing element 182 disposed in the radiator line 172 and connected to the clutch 180 by a control line 184. During normal operation of the system 10, with no coolant flow through the radiator line 172, the coolant temperature in line 172 is below the temperature setting of the sensing element 182 so that the clutch 180 is decoupled and the radiator fan 164 is inoperative. The engine power normally needed to operate the cooling fan is thus available to assist in pumping and vaporizing the nitrogen. In the event that operation of the radiator 162 is needed, the thermostatic control valve 138 automatically creates a flow through the radiator via the radiator line 172 so that the temperature of coolant in line 172 exceeds the temperature setting of the element 182 to in turn engage the clutch 180 and cause the radiator fan 164 to blow ambient air 166 across the radiator.

The unique ability of the system 10 to utilize coolant at a very low temperature compared to conventional systems provides the system 10 with a variety of other structural and operational advantages. For example, because the temperature of the coolant between the coolant pump 112 and the engine coolant line 168 is in the range of 70°–72° F. instead of a minimum of 160° F. as in conventional systems, the overall temperature differential between opposite sides of the heat exchangers 130, 132, and 136 is significantly increased. Accordingly, these heat exchangers may be significantly smaller than in conventional systems which yields a considerable heat exchanger size and cost reduction. Additionally, because the available coolant temperature has been significantly lowered, the operating temperatures within the hydraulic drive circuit and the lube oil circuit may be maintained at significantly lower controlled temperatures to thereby extend the life of the mechanical components within such circuits. Specifically, the minimum fluid temperatures in such circuits is now considerably lower than the 160° F. previously obtainable in conventioal systems.

It is also important to note that while the minimum coolant temperature in the system 10 (immediately downstream from the cryogenic heat exchanger 58) has been representatively described as being approximately 70° F., such minimum temperature could be maintained at a significantly lower level if desired. In fact, in the system 10, the only limitation on the minimum cooling temperature is the freezing point of the particular coolant being used. Accordingly, such minimum temperature could be lowered to approximately 20° F. if desired.

Another important advantage provided by the system 10 is its ability to very precisely control the temperature of the coolant flowing through the coolant fluid flow circuit downstream from the cryogenic heat exchanger 58. This is due to the precise heat control provided by the dynamometer and the unique placement of the thermostataic control valve 138 which has an integral temperature sensor positioned downstream from the radiator 162. The valve 138 in the system of the present invention representatively depicted in the drawing is set at 160° F. This prevents accidental overheating of the engine due to operator error.

In conventional systems, this temperature sensing element is placed upstream from the engine radiator to divert coolant flow therethrough when the sensed temperature of the coolant indicates the need for diversion of a portion of the coolant through the radiator. While this temperature sensor placement functions in a suitable manner to protect the driving engine, it also yields rather wide variations in the circulating coolant temperature. However, with the temperature sensor of the thermostatic control valve 138 positioned downstream from the radiator, a considerably more precise control of the maximum coolant temperature is achieved.

Thus far, the operation of the system 10 has been described with the system operating in its steady state mode with a constant flow of liquid nitrogen being vaporized and heated to a predetermined discharge temperature. In such steady state operation, the coolant heat being extracted from the coolant flow circuit to vaporize and heat the liquid nitrogen is precisely matched by the heat being added to the coolant at the heat exchangers 130, 132 and 136 and the heat being added to the coolant within the dynamometer internal flow passage 178 and through the engine cooling line 168. Because of this rather precise heat balance afforded by the system 10, except for normal heat exchange in efficiencies, there is no excess heat being dissipated to atmosphere since the radiator 162 is normally not functioning. Stated otherwise, essentially all of the available heat generated by the system is being transferred to the coolant in the coolant fluid flow circuit. Other than the normal ambient heat loss from system components at higher than ambient temperatures, all of the excess heat generated by the system is being utilized to vaporize and heat the flowing nitrogen.

When it is desired to alter the flow of liquid nitrogen through the system 10, the output of the main hydraulic pump 30 is simply adjusted to provide a greater or lesser flow of hydraulic fluid through the conduit 38. The variation in hydraulic fluid flow through conduit 38 automatically strokes the hydraulic motor 40 to accordingly vary its speed to alter the nitrogen output flow from the nitrogen pump 52. If, for example, the output flow from the nitrogen pump 52 is increased, the nitrogen pumping load borne by the engine 18 will increase and additional engine heat will be transferred to the coolant within the coolant fluid flow circuit.

However, this additional engine heat will be insufficient to maintain the temperature of the gaseous nitrogen 16 at its previous level. Accordingly, when the nitrogen flow rate is increased in this manner, additional heat must be supplied to the coolant, via the dynamometer 36, by further opening the dynamometer control valve 158. In a similar manner, if the nitrogen flow is reduced the temperature of the discharged gaseous nitrogen will rise, and the control valve 158 must be adjusted to reduce the dynamometer load.

This independence between the nitrogen flow rate and the artificial system load imposed by the dynamometer 36 permits the system 10 to be very precisely "tuned" from a heat balance standpoint. Such ability to precisely match the heat added to and extracted from the coolant flow circuit significantly enhances the operational efficiency of the system 10 compared, for example, to conventional system which attempt to maintain a proportionality between the cryogenic flow rate and the heat created by the artificial load means.

In such systems, because the engine shaft load imposed by the artificial load means is automatically made to track the nitrogen pumping load, the artificial load must be fixed at a minimum level sufficient to completely vaporize the nitrogen at the minimum back pressure likely to be encountered by the discharged gaseous nitrogen. Accordingly, during normal operation of such conventional systems, the artificial load means unavoidably create an excess amount of available heat which must be continually rejected from the system via the engine radiator. Additionally, this unavoidable generation of excess heat often requires the use of a tempering valve at the cryogenic heat exchanger to reduce the discharge temperature of the vaporized nitrogen.

As previously described, however, in the system 10 of the present invention this previous necessity of continuously dissipating heat to the atmosphere, and/or the use of a tempering valve, is uniquely avoided by the unique use of the dynamometer 36 as the system's artificial load means due to the fact that the dynamometer load may be adjusted wholly indepenently of the nitrogen flow rate. In this manner, regardless of the nitrogen flow rate, or the back pressure to which the discharged nitrogen is subjected, the system 10 may be easily adjusted to very accurately balance the heat transferred into the coolant flow circuit from the engine and dynamometer with the heat being transferred from the coolant circuit into the flowing nitrogen.

It should also be noted that in conventional systems which must maintain the coolant temperature at or above approximately 160° F. to prevent damage to the driving engine, additional heat is also lost to the atmosphere from the piping itself due to the relatively large temperature differential between the coolant and ambient air temperature. This heat loss is also considerably reduced in the system 10 due to its ability to operate with coolant at a much lower temperature level. For example, with the coolant at approximately 70°–72° in the bulk of the supply conduit 126, there will be many days when the ambient temperature is greater than that of the coolant. Because of this feature, there will often be a desirable flow of ambient heat into the coolant flow circuit which will further increase its overall operating efficiency.

It should further be noted that due to the unique coolant temperature control of the parallel-connected engine 18, which is essentially independent of the coolant circuit temperature, operator error in adjusting the coolant circuit temperature cannot damage the engine as it could in conventional systems since the coolant fluid circuit is connected in parallel with the engine as previously described.

To facilitate the operation of the dynomometer 36, the coolant flow circuit is operated in a unique "two level" mode. When the system 10 is inoperative, coolant within the dynamometer drains by gravity into the vented coolant reservoir 122 which is disposed at a level lower than that of the dynamometer so that the coolant level in the coolant flow circuit is at a high point 186 somewhat below the high point $\mathbf{126}_a$ of the supply conduit 126. However, during normal operation of the system 10, the level 186 of the coolant is automatically lowered, by operation of the coolant pump 112, to level 188 within the coolant reservoir 122 so that the dynamometer fluid can be discharged to atmosphere (within the reservoir 122) by gravity through the conduit 156. In this manner, the fluid discharge resistance on the dynamometer (which functions as an extremely inefficient centrifugal pump) is kept to a minimum so that the dynamometer may be easily and smoothly operated to provide the previously described precise heat balance within the system 10.

The foregoing detailed description is to be clearly understood as being given by way of illustration and example only, the spirit and scope of the present invention being limited solely by the appended claims.

What is claimed is:

1. A system for pumping and heating a process fluid, comprising:

engine means for supplying shaft power and responsively generating engine heat;

a coolant flow circuit having a coolant pump therein, said coolant pump being drivable to flow a coolant fluid through said coolant flow circuit;

a process fluid flow circuit having a process fluid pump therein, said process fluid pump being drivable to flow a process fluid from a source thereof through said process fluid flow circuit;

first heat exchange means for transferring heat generated by said engine means to the coolant fluid;

second heat exchange means for transferring heat from the coolant fluid to the process fluid;

power transfer means for utilizing shaft power supplied by said engine means to drive said coolant pump and said process fluid pump; and load means operable to utilize coolant fluid to impose upon said engine means a selectively variable additional shaft power load which is independent of the process fluid pumping shaft power load thereon, and to produce heat which is transferred directly from said load means to the coolant fluid.

2. The system of claim 1 wherein:

said load means include a dynamometer having a fluid flow passage extending therethrough and connected in parallel with said coolant flow circuit, and flow control means for diverting a selectively variable portion of the coolant fluid traversing said coolant flow circuit through said fluid flow passage of said dynamometer, and said power transfer means are further operative to drive said dynamometer.

3. The system of claim 2 wherein:

said fluid flow passage of say dynamometer is interposed in a branch coolant supply conduit connected in parallel with said coolant flow circuit ahd having an inlet end, and said flow control means include a flow control valve connected in said branch coolant supply conduit, and a back pressure valve connected in said coolant flow circuit downstream from said inlet end.

4. The system of claim 3 wherein:

said coolant flow circuit includes a vented coolant reservoir positioned lower than said dynamometer and adapted to receive coolant fluid discharged from said dynamometer through said branch coolant supply conduit.

5. The system of claim 4 wherein:

said coolant flow circuit further includes a main coolant fluid supply conduit connected to said vented coolant reservoir and having a portion defining a high point of said coolant flow circuit, whereby when said system is inoperative the coolant fluid assumes a first level within said coolant flow circuit, and when said system is operating the coolant fluid assumes a second, lower level within said coolant flow circuit so that said dynamometer discharges coolant fluid to atmosphere within said coolant reservoir.

6. The system of claim 1 wherein:

said engine means have a coolant jacket, an integral coolant circulation system adapted to circulate coolant through said coolant jacket, and a minimum acceptable coolant temperature within said coolant jacket, said coolant flow circuit includes a main coolant fluid supply conduit, and said integral coolant circulation system of said engine means is connected in parallel with said main coolant fluid supply conduit, whereby the temperature of coolant fluid within said system may be kept at a temperature substantially below said minimum acceptable coolant temperature within said coolant jacket of said engine means.

7. The system of claim 6 wherein:

said minimum acceptable coolant temperature within said coolant jacket of said engine means is approximately 160°, and the maximum temperature of coolant fluid within said system, during normal operation thereof, is substantially less than 160° F.

8. The system of claim 6 wherein:

said engine means have a radiator and a cooling fan operable to blow air across said radiator, and said radiator is connected in parallel with said main coolant fluid supply conduit to receive a flow of coolant fluid therefrom.

9. The system of claim 8 wherein:

said system further comprises thermostatic control valve means operative to selectively flow coolant fluid through said radiator and having a temperature sensing portion positioned to sense the temperature of coolant fluid downstream from said radiator.

10. The system of claim 8 wherein:

said system further comprises clutch means operatively coupled to said cooling fan, and means for sensing coolant fluid flow through said radiator and responsively controlling said clutch means to operate said cooling fan.

11. The system of claim 1 wherein:

said system further comprises a lube oil flow circuit operatively connected to said power transfer means and said process fluid pump to deliver lubricating oil thereto, said lube oil flow circuit having a lube oil pump interposed therein and drivable by said power transfer means to circulate lubricating oil therethrough, third heat exchange means interposed in said lube oil circuit for transferring heat from said lube oil flow circuit to said coolant flow circuit, and first thermostatic control valve means for controlling the flow of lubricating oil through said third heat exchange means, said power transfer means include a hydraulic fluid drive circuit, and said system further comprises fourth heat exchange means interposed in said hydraulic fluid drive conduit for transferring heat from said hydraulic fluid drive circuit to said coolant flow circuit, and second thermostatic control valve means for controlling the low of hydraulic fluid through said fourth heat exchange means.

12. A cryogenic liquid pumping an vaporization system comprising:

a cryogenic fluid flow circuit having a cryogenic fluid pump interposed therein and being drivable to flow a cryogenic liquid from a source thereof through said cryogenic fluid flow circuit at a selectively variable rate;

a coolant fluid flow circuit having a coolant fluid pump interposed therein and being drivable to flow a coolant fluid through said coolant flow circuit;

an engine adapted to supply shaft power and responsively generate engine heat;

first power transfer means for transmitting a selectively variable first portion of said shaft power of said engine to said cyrogenic fluid pump to adjustable drive the same;

second power transfer means means for transmitting a second portion of said shaft power of said engine to said coolant fluid pump to drive the same;

a dynamometer having a fluid flow passage connected in parallel with said coolant fluid flow circuit;

third power transfer means for transmitting a third portion of said shaft power of said engine to said dynamometer to drive the same;

flow control means for flowing a selectively variable quantity of coolant fluid from said coolant fluid flow circuit through said fluid flow passage of said dynamometer;

first heat exchange means for transferring engine heat to the coolant fluid; and second heat exchange means for transferring heat from the coolant fluid to the cyrogenic fluid to heat and vaporize the same.

13. The system of claim 12 wherein:

said engine has an integral cooling circuit connected in parallel with said coolant fluid flow circuit.

14. The system of claim 13 wherein:

said engine has a radiator connected in parallel with said coolant fluid flow circuit, and a cooling fan operable to blow air across said radiator.

15. The system of claim 14 wherein:

said system further comprises a thermostatic control valve operatively positioned in said coolant fluid flow circuit for sensing the temperature of coolant fluid therein and responsively controlling the flow of coolant fluid through said radiator.

16. The system of claim 15 wherein:

said thermostatic control valve has a temperature sensing portion positioned in said coolant fluid flow circuit downstream from said radiator.

17. The system of claim 14 wherein:

said system further comprises clutch means operatively associated with said cooling fan, and means for sensing coolant flow through said radiator and responsively operating said clutch means to control the operation of said cooling fan.

18. The system of claim 12 wherein:

said coolant fluid flow circuit includes a vented coolant reservoir positioned lower than said dynamometer and adapted to receive coolant fluid discharged from said fluid flow passage of said dynamometer.

19. The system of claim 18 wherein:

said coolant fluid flow circuit further includes a main coolant fluid supply conduit connected to said vented coolant reservoir and having a portion positioned higher than the balance of said coolant fluid flow circuit, whereby when said system is inoperative the coolant fluid assumes a first level within said coolant fluid flow circuit, and when said system is operating the coolant fluid assumes a second, lower level within said coolant fluid flow circuit so that said dynamometer discharges coolant fluid to atmosphere with said vented coolant reservoir.

20. The system of claim 12 wherein:

said first and second power transfer means include a hydraulic fluid drive circuit adapted to circulate a quantity of hydraulic fluid, and said system further comprises third heat exchange means interposed in said hydraulic fluid drive circuit for transferring heat from said hydraulic fluid drive circuit to said coolant fluid flow circuit, and thermostatic control valve means for controlling the flow of hydraulic fluid through said third heat exchange means.

21. The system of claim 12 further comprising:

a lube oil flow circuit having a lube oil pump interposed therein and being drivable by said engine, said lube oil flow circuit being connected to portions of said first, second and third power transfer means and to said cryogenic fluid pump for flowing lubricating oil therethrough during operation of said lube oil pump, third heat exchange means interposed in said lube oil flow circuit for transferring heat from said lube oil flow circuit to said coolant fluid flow circuit, and thermostatic control valve means for controlling the flow of lubricating oil through said third heat exchange means.

22. The system of claim 12 wherein:

said first power transfer means include a variable displacement hydraulic pump driven by said engine and hydraulically coupled to a variable displacement hydraulic motor drivingly connected to said cryogenic fluid pump.

23. The system of claim 12 wherein:

said second power transfer means include a fixed displacement hydraulic pump driven by said engine and hydraulically coupled to a fixed displacement hydraulic motor drivingly connected to said coolant fluid pump.

24. The system of claim 12 wherein:

said first heat exchange means include means for transferring heat from exhaust gas discharged from said engine to said coolant fluid flow circuit.

25. A method of vaporizing a liquified gas comprising the steps of:

pumping the liquified as through a first flow path;

pumping a liqud coolant through a second flow path;

providing a dynamometer having a fluid flow passage;

utilizing output power from a heat engine to effect the pumping of the liquified gas and the liquid coolant, and to drive said dynamometer;

diverting a selectively variable flow of the liquid coolant from said second flow path through said fluid flow passage of said dynamometer in a manner selectively varying the dynamometer driving load on said heat engine without varying the flow rate of liquified gas through said first flow path;

transferring heat from said heat engine to the liquid coolant; and transferring heat from the liquid coolant to the liquified gas to vaporize the same.

26. The method of claim 25 wherein:

said heat engine has a cooling circuit, and said method further comprises the step of connecting said coolant circuit in parallel with said second flow path.

27. The method of claim 26 wherein:

said heat engine has a minimum coolant jacket fluid operating temperature, and said method further comprises the step of maintaining the maximum temperature of liquid coolant within said second flow path substantially below said minimum coolant jacket fluid operating temperature.

28. The method of claim 27 wherein:

said heat engine has a radiator, said method further comprises the step of connecting said radiator in parallel with said second flow path, and said step of maintaining the maximum temperature includes the steps of providing a thermostatic control valve having a temperature sensing portion communicating with said second flow path downstream from said radiator, and utilizing said thermostatic control valve to regulate the flow of liquid coolant through said radiator.

29. The method of claim 25 wherein:

said step of transferring heat from said heat engine to the liquid coolant includes the step of transferring exhaust gas heat from said heat engine to said liquid coolant.

30. The method of claim 25 wherein:

said step of utilizing output power from a heat engine includes the step of utilizing a hydraulic fluid flow circuit, and said method further comprises the step of transferring heat from said hydraulic fluid flow circuit to the liquid coolant.

31. The method of claim 25 wherein:

said step of utilizing output power from a heat engine includes the step of interconnecting power transfer means between said heat engine and pumping means positioned in said first and second flow paths, and said method further comprises the steps of utilizing a lube oil flow circuit to lubricate said power transfer means, and transferring heat from said lube oil flow circuit to the liquid coolant.

32. A method of pumping and heating a process fluid comprising the steps of:

providing a coolant flow circuit having a coolant pump interposed therein and operable to flow a coolant fluid therethrough;

providing a process fluid flow circuit having a process fluid pump interposed therein and operable to flow a process fluid therethrough;

providing engine means for supplying output power and responsively generating engine heat;

utilizing output power from said engine means to operate said coolant pump and said process fluid pump;

transferring engine heat to the coolant fluid;

transferring heat from the coolant fluid to the process fluid;

providing power absorbing means for utilizing a flow of coolant fluid from said coolant flow circuit to impose a selectively variable additional power output load on said engine means without appreciably altering the process fluid pumping load thereon, and for generating additional heat;

flowing coolant fluid from said coolant flow circuit to said power absorbing means; and transferring said additional heat from said power absorbing means directly to the coolant fluid.

33. The method of claim 32 wherein:

said step of providing power absorbing means includes the step of providing a dynamometer, and said method further comprises the step of utilizing output power from said engine means to drive said dynamometer.

* * * * *